United States Patent [19]

Bachhofer et al.

[11] 4,410,339

[45] Oct. 18, 1983

[54] APPARATUS FOR WASHING AIR IN AIR-CONDITIONING SYSTEMS

[76] Inventors: Bruno Bachhofer, Säntisstr. 85, Bavendorf, Fed. Rep. of Germany, D-7981; Anton Locher, Bergstr. 6, Ravensburg, Fed. Rep. of Germany, D-7980

[21] Appl. No.: 319,383

[22] Filed: Nov. 9, 1981

Related U.S. Application Data

[63] Continuation of Ser. No. 175,902, Aug. 6, 1980, abandoned.

[30] Foreign Application Priority Data

Aug. 29, 1979 [DE] Fed. Rep. of Germany ..... 2934846

[51] Int. Cl.[3] ..... B01D 47/06; A61L 9/14

[52] U.S. Cl. ..... 55/228; 55/85; 55/89; 55/279; 261/6; 422/4; 422/5; 422/37; 422/123; 210/192; 210/196

[58] Field of Search ..... 55/85, 89, 228, 279; 422/4, 5, 31, 37, 123; 210/192, 196, 753, 754, 760, 764; 261/5, 6

[56] References Cited

U.S. PATENT DOCUMENTS

| | | | |
|---|---|---|---|
| 2,090,466 | 8/1937 | Bichowsky | 55/228 |
| 2,207,774 | 7/1940 | Barthelemy | 55/85 |
| 2,405,553 | 8/1946 | Allison | 210/192 |
| 2,606,150 | 8/1952 | Thorp | 210/760 |
| 2,771,416 | 11/1956 | Ryan | 210/760 |
| 2,874,032 | 2/1959 | Kuehner | 422/4 |
| 3,326,747 | 6/1967 | Ryan et al. | 210/760 |
| 3,366,441 | 1/1968 | Ellner et al. | 55/279 |
| 3,445,001 | 5/1969 | Raus | 210/192 |
| 3,805,481 | 4/1974 | Armstrong | 210/760 |
| 4,256,710 | 3/1981 | Azuma et al. | 422/4 |

FOREIGN PATENT DOCUMENTS

| | | | |
|---|---|---|---|
| 2301127 | 7/1974 | Fed. Rep. of Germany | 210/754 |
| 2332058 | 1/1975 | Fed. Rep. of Germany | 210/760 |
| 2450731 | 4/1976 | Fed. Rep. of Germany | 210/760 |
| 2632298 | 1/1978 | Fed. Rep. of Germany | 55/85 |
| 46-22390 | 6/1971 | Japan | 55/85 |
| 53-93170 | 8/1978 | Japan | 210/754 |
| 54-99775 | 8/1979 | Japan | 55/89 |
| 1419537 | 12/1975 | United Kingdom | 210/760 |

*Primary Examiner*—David L. Lacey
*Attorney, Agent, or Firm*—Amster, Rothstein & Engelberg

[57] ABSTRACT

An air washing apparatus consisting essentially of two separate cyclic units. In the first cyclic unit, air is sprayed with a fluid consisting of water and a halogen. The spray removes impurities from the air, and brings the impurities into the fluid supply from which the impurities are removed in the second cyclic unit, by treating the fluid with ozone. After treatment, the fluid is returned to the fluid supply where the halogen in the fluid supply removes any ozone present, and thereby renders the fluid safe.

4 Claims, 1 Drawing Figure

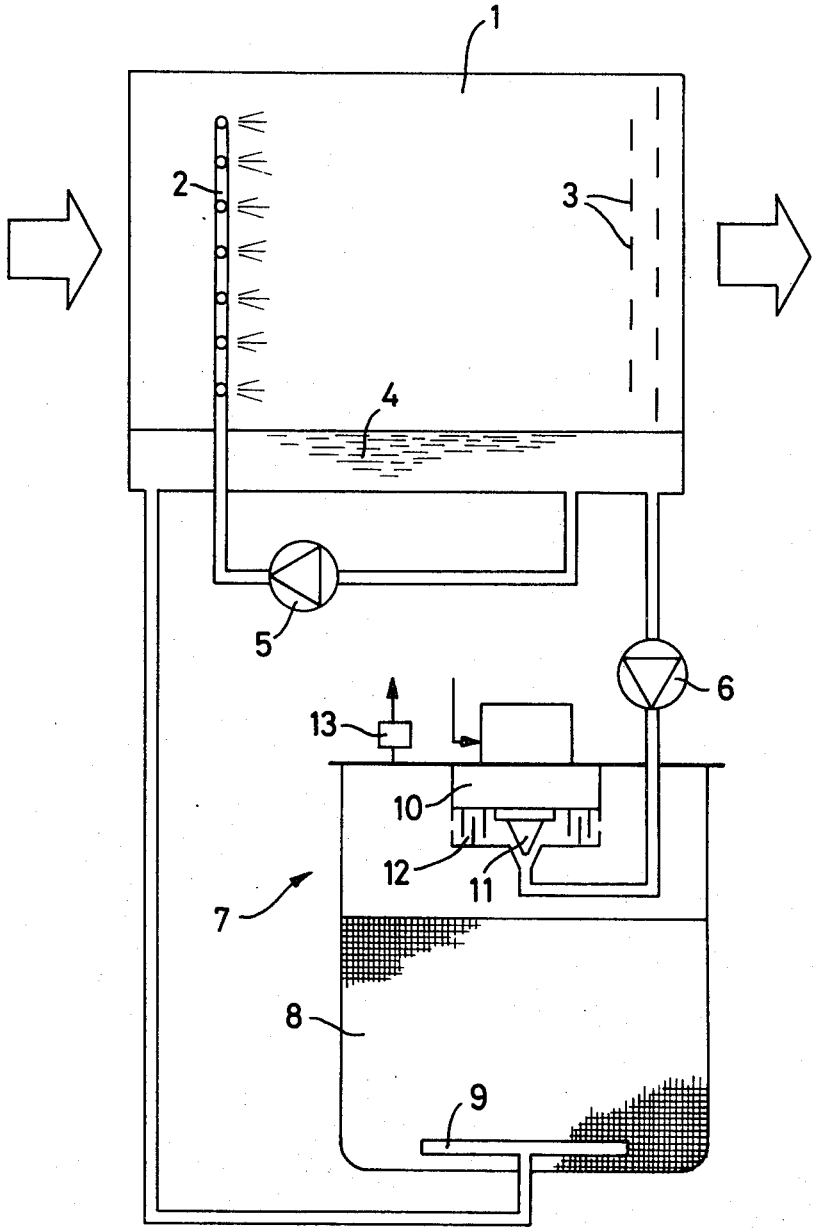
1
2
3
4
5
6
7
8
9
10
11
12
13

APPARATUS FOR WASHING AIR IN AIR-CONDITIONING SYSTEMS

This is a continuation of application Ser. No. 175,902, filed Aug. 6, 1980, now abandoned.

The invention relates to a process for washing air in air-conditioning systems using a spray chamber through which the air is passed and in which a mist spray is produced by spraying and recovering a supply of washer water.

This type of air washing causes the air to be moistened and dust particles to be separated. However, the additional problem of air disinfection arises in air-conditioned places having a particularly high occurrence of germs, such as, for example in hospitals, and it has hitherto been impossible to find a satisfactory solution to this problem. It is generally known that, despite the addition of chemical disinfectants to the recirculating water spray, extremely high numbers of bacterial colonies are found in the spray chambers. In addition, disinfectants create their own problems, in particular problems of smell in living rooms. Moreover, it was hitherto impossible to deal with the growth of bacteria in the ventilation ducts of air-conditioning systems and with the subsequent introduction of germs into the air caused thereby.

The disinfection of air with ozone is adversely affected by the control engineering problem of adding only as much ozone as can be reduced by the undesired organic substances which are contained in the air at the time. It is important in any case to avoid an excess of ozone in the inhaled air, as it is poisonous. The threshold limit value (TL value) which is specified in the relevant Public Health Authority Regulations is 0.1 ppm of ozone.

It is the underlying object of the invention to propose a process of air disinfection which can be used in air-conditioning systems, which has no troublesome or harmful side-effects and which considerably improves the hitherto prevailing situation, particularly in places where there is a high demand for air hygiene.

This object is achieved in accordance with the invention by an air washing process of the type described in the introduction in that the washer water is treated with ozone in a recirculating system and contains a halogen which reacts with ozone.

It has been found that, contrary to the fears of the experts and approving authorities, an excess quantity of ozone in the conditioned air is reliably avoided. Bromine, which exists at first in the form of dissolved bromide in water, is responsible for preventing this excess. This bromine causes decomposition, if necessary outside the ozone treatment unit, of the excess ozone in the water to form hypobromite or bromine dioxide. Measurements taken on a test system showed that the maximum concentration of ozone occurring in the water flowing to the spray nozzles was 0.03 ml/m$^3$ and a maximum of 0.01 ppm at the space ventilating jets of the air-conditioning system.

Disinfection of the air is completed in two stages or can be seen in two forms. Firstly, germs and other undesirable water-containing substances are washed out of the air, passed with the water into the ozone treatment unit and are promptly burned therein by contact with concentrated ozone and are then filtered out. Secondly, the "ozone-activated bromine" (hypobromite or bromine dioxide)—produces a germ-free medium in the washer and, as has been found, also in the ventilating ducts of the air-conditioning system. Colonies of bacteria are no longer found in these places. The second type of permanent disinfection does not therefore take place only in the water spray. Rather, when the air is humidified active oxygen from the said bromine-oxygen compounds is added to the air stream, which results in a considerable reduction in the numbers of germs in the air-conditioned places and has a very beneficial effect on the health of the patients, for example during operations of long duration or in intensive care units.

The bromine content of the water spray is not consumed. The oxidation processes and the reduction processes which are associated with disinfection can be reversed and the corresponding states of the bromine create an equilibrium. This can be measured by measuring the redox potential and can also be controlled by influencing the quantity of ozone correspondingly.

Apart from the certain destruction of all germs and viruses in the conditioned air, the invention also has the advantage that the expenditure required for the maintenance and cleaning of the washer chambers can be reduced in a lasting manner.

An exemplary embodiment of the invention will be explained with the aid of the drawing.

A spray chamber 1 is inserted in the service duct of an air-conditioning system and a stream of air passes through the said chamber in the direction of the arrow. Spray nozzles 2 are diagrammatically shown in the left-hand side of the chamber and baffle plates 3 in the right-hand side. The lower part of the spray chamber 1 contains a water supply 4, from which a recirculating pump 5 extracts the washer water at the bottom of the spray chamber and delivers it to the spray nozzles 2. A further recirculating system runs from the water supply 4 via a recirculating pump 6 and back to the water supply 4 via an ozone treatment unit 7.

The ozone treatment unit 7 consists of a tank which is partially filled with fine filter gravel 8 and comprises a star-shaped filter tube 9 at the outlet end. Mounted on the inside of the tank lid is an ozone generator 10 which is fed from the outside with dried compressed air and with a high voltage. The ozone gas emerges from the underside of the ozone generator via a non-return valve 11. The non-return valve 11 is enclosed by a mixer chamber 12 which is adjacent to the bottom of the ozone generator 10 and contains baffles. The water supply line is introduced into the tank through the lid thereof and connected to the bottom of the mixer chamber 12. In the mixer chamber the water which flows in through the supply line is mixed intensively with the ozoniferous gas emerging from the non-return valve 11, and thereafter leaves the mixer chamber in a radial direction. The water now becomes non-turbulent and diffuses at only a slow rate downwards through the filter gravel 8. In the course thereof, air and excess ozone collect at the top of the tank and leave the tank via a float-controlled de-aerating valve 13 to which an activated charcoal filter (not shown) is connected for destroying the remaining ozone.

The water spray contains, in addition to bromide or bromine, a nutrient-free complexing agent to prevent the formation of lime deposits.

From time to time the filter is subjected to back-washing with the aid of devices (not shown) using the washer water. This back-wash water, which is diverted into the drain is then replaced by fresh water, the washed out substances being replenished by adding a corresponding quantity of hydrobromic acid and complexing agents.

We claim:

1. Apparatus for removing impurities from air in an air-conditioning system comprising:

a first cyclic unit including a spray chamber having a plurality of nozzles for spraying a fluid comprising a mixture of water and a halogen into air passing therethrough, said spray chamber further having a fluid supply including said mixture of water and halogen and located in the bottom of said spray chamber to provide fluid to said spray nozzles, and a first fluid connector with an inlet for receiving fluid from said fluid supply and an outlet coupled to said spray nozzles for transferring fluid from said fluid supply in said spray chamber to said spray nozzles; and a second cyclic unit spaced apart from said first cyclic unit and including a tank, an ozone treatment unit mounted in said tank, said ozone treatment unit including an ozone generator therein, a second fluid connector having an inlet in said fluid supply spaced apart from said inlet of said first fluid connector and an outlet, said second cyclic unit further including a mixer chamber connected to said outlet of said second fluid connector for receiving the ozone generated by said ozone generator and the fluid flowing through said second fluid connector and mixing said ozone and said fluid to remove impurities from said fluid, a third fluid connector having an inlet in said tank and an outlet coupled to said fluid supply for transferring said ozone treated fluid from said tank to said fluid supply, said tank including a filter section located between said ozone treatment unit and said inlet of said third fluid connector through which filter section the ozone treated fluid passes.

2. Apparatus according to claim 1 wherein said first fluid connector includes a first recirculating pump, and said second fluid connector includes a second recirculating pump.

3. Apparatus according to claim 2 wherein said mixer chamber includes a non-return valve preventing entry of said fluid into said ozone generator, and a de-aerating valve is provided in said ozone treatment unit to allow escape of excess ozone.

4. Apparatus of claim 2 wherein said halogen is bromide which reacts with said ozone to form bromide dioxide.

* * * * *